United States Patent [19]

Nagatomo et al.

[11] Patent Number: 4,719,755

[45] Date of Patent: Jan. 19, 1988

[54] STIRLING ENGINE

[75] Inventors: Shigemi Nagatomo, Tokyo; Minoru Komori, Ebina; Tsutomu Sakuma, Yokohama; Noboru Kagawa, Tokyo; Takashi Komakine, Kawaguchi; Toshinori Iwasaki, Kawasaki; Akira Kudo, Yokohama, all of Japan

[73] Assignee: Kabushiki Kaisha Toshiba, Japan

[21] Appl. No.: 764,117

[22] Filed: Aug. 9, 1985

[30] Foreign Application Priority Data

Aug. 11, 1984 [JP] Japan ..... 59-167282

[51] Int. Cl.[4] ..... F02G 1/04

[52] U.S. Cl. ..... 60/525

[58] Field of Search ..... 60/517, 525, 526

[56] References Cited

U.S. PATENT DOCUMENTS 3,812,677 5/1974 Gries ..... 60/517
4,392,350 7/1983 Marks ..... 60/525

FOREIGN PATENT DOCUMENTS 1016183 11/1952 France .
1022203 3/1953 France .
58-25556 2/1983 Japan .
2118635 11/1983 United Kingdom .

OTHER PUBLICATIONS

Abstract No. 104, (M-212) of Japanese Patent Application No. 58-25556, 5/1983.
Abstract No. 283, (M-263) of Japanese Patent Application No. 57-40472, 12/1983.
Abstract No. 20, (M-271) of Japanese Patent Application No. 57-60321, 1/1984.
Abstract No. 207, (M-242) of Japanese Patent Application No. 58-104349, 9/1983.

*Primary Examiner*—Allen M. Ostrager
*Attorney, Agent, or Firm*—Schwartz, Jeffery, Schwaab, Mack, Blumenthal & Evans

[57] ABSTRACT

A Stirling engine which has an expansion cylinder and a compression cylinder with an expansion piston and a compression piston, respectively, that have a fixed phase difference between them, where the expansion cylinder and the compression cylinder are connected through a heater, a regenerator, and a cooler, a fixed amount of working fluid is sealed in the expansion cylinder and a compression cylinder, and the engine is driven by heating or cooling the working fluid with the heater or the cooler, and in the above Stirling engine, the heater for heating the working fluid includes a combustion chamber attached to the expansion cylinder, a burner for jetting a combustible substance into the combustion chamber, a plurality of heat exchanger pipes for forming a plurality of passages for the working fluid to connect through between the expansion cylinder and the regenerator by turning back on themselves, in order to heat the working fluid with the high temperature gas from the burner, and a cylinder head for installing the plurality of heat exchanger pipes, in a concentric configuration with approximately equal distance apart and with an inclination of predetermined angle, on the expansion cylinder, in order to make equal the lengths of the passages for the working fluid between the expansion cylinder and the regenerator.

9 Claims, 7 Drawing Figures

STIRLING ENGINE

BACKGROUND OF THE INVENTION

1. Field of the Invention

The present invention relates to a Stirling engine, and in more detail, relates to a heater for a Stirling engine which enables further improvement in heat exchange efficiency.

2. Description of the Prior Art

Generally speaking, a Stirling engine is aimed at realizing Stirling's cycle, which is formed by the four processes of an isothermal compression 1→2, an isochoric cooling 2→3, an isothermal compression 3→4, and an isochoric heating 4→1, as shown in FIG. 1. As one Stirling engine for realizing the Stirling's cycle, there is known a two-piston type engine which is shown in FIG. 2. It has a first cylinder 14 and a second cylinder 16 with a first power piston 10 and a second power piston, respectively, that have a phase difference of about 90° between them. The first cylinder 14 and the second cylinder 16 are connected through three heat exchangers, namely, a heater 18, a regenerator 20, and a cooler 22 within the first cylinder 14 and the second cylinder 16, there is sealed a fixed amount of working fluid which is heated or cooled by the heater 18 or the cooler 22. The operation of the above Stirling engine can be described as follows. After self-sustaining operation of the engine is realized, in the isochoric heating period, the first power piston 10 moves downward from the top dead point, with accompanying heated expansion (the pressure going up) of the expansion space. At the same time, the second power piston 12 moves upward toward the top dead point. Therefore, the volume of the working fluid remains unchanged, with a shift of the working fluid at lower temperature toward the higher temperature side, in which the working fluid is heated to a higher temperature by recovering heat from the regenerator. Since, in the isothermal expansion period, the first power piston 10 moves further downward and the second power piston 12 comes down also, the space for the working fluid expands and its pressure goes down. During this period, the Stirling engine transfers energy to the exterior due to the heating by the heater. In the isochoric cooling period, the first power piston 10 moves upward from the bottom dead point and the second power piston 12 moves to the bottom dead point, so that the volume of the working gas at a higher temperature shifts toward the lower temperature side, with its temperature being reduced by storing heat in the regenerator 20. In the isothermal compression period, the first power piston 10 moves further upward and the second power piston 12 moves upward also, so that the space for the working fluid is compressed with the accompanying rise in the pressure. During this period, the Stirling engine receives energy from the exterior.

The difference between the energy output to the exterior during the isothermal expansion and the energy received from the exterior during the isochoric compression becomes the net output of the Stirling engine, the magnitude of which is proportional to the difference between the temperatures of the expansion and the compression and to the amount of the gas stored in the engine. The regenerator 20 is for storing the heat during the isochoric cooling with the temperature difference being maintained as well, and for utilizing the heat by regenerating it during the isochoric heating, which enables one to attain a more satisfactory heat efficiency.

In the prior art Stirling engine of two-piston type, one end of a cooler 25, which extends approximately perpendicularly in the direction of action of the second power piston, is joined to the upper portion of a second cylinder 24, and the other end of the cooler 25 is joined to one end of a regenerator 28, as shown by FIG. 3. The other end of the regenerator 28 and the upper portion of a first cylinder 26 are connected with a plurality of heating pipes 30, and a combustion chamber 34 is formed by providing a combustion duct 32 around the heating pipes 30. It is arranged to heat the working fluid in the heating pipes 30 by burning the combustion gas which is introduced through the combustion gas intake 35 provided on the combustion duct 32. However, in the prior art Stirling engine of the above kind, the duct lengths of the working fluid between the first cylinder 26 and the regenerator 28 become unequal because of the nonuniformity in the length of the plurality of heating pipes 30 due to structural reasons. Accordingly, the flow amount of the higher temperature fluid in the heated state that is in each of the heating pipes 30 becomes nonuniform. In addition, in the Stirling engine as described above, where the heating parts in the combustion chamber 34, namely, the heating pipes 30, are expanded by heating, there will be applied an excessive force to each of the joining sections, adversely affecting a cause, for reading in the life of the device. This leads to a reductin in the output performance of the engine as a result of reduction in the heat input, restrained by the heating pipes with smaller amount of flow, of the temperature of the combustion gas that heats the heating pipes. Furthermore, the distribution of the combustion gas becomes nonuniform, preventing improvement in the heat exchange efficiency.

SUMMARY OF THE INVENTION

An object of the present invention is to provide a heater for a Stirling engine which enables one further to improve heat exchange efficiency.

Another object of the present invention is to provide a Stirling engine which enables one to improve the output performance of the engine.

Another object of the present invention is to provide a Stirling engine which enables one to set the heating temperature for the heater at a high value.

Another object of the present invention is to provide a Stirling engine which enables one to obtain a uniform distribution of the combustion gas.

Another object of the present invention is to provide a heater for a Stirling engine which enables one to eliminate the harmful effects due to expansion of the heated parts.

In a Stirling engine that has a first cylinder and a second cylinder with a first power piston and a second power piston, respectively, that a fixed phase difference between them, where the first cylinder and the second cylinder are connected through a heater, a regenerator, and a cooler, and the engine is driven by heating or cooling a fixed amount of working fluid that is sealed in the first cylinder and the second cylinder by means of the heater and the cooler, one of the characteristics of the present invention is that the heater for heating the working fluid includes a combustion chamber that is attached to the first cylinder, a burner for injecting combustion material into the combustion chamber, a plurality of heat exchanger pipes which form a plurality of passages for the working fluid that join the first cylinder and the regenerator in a turned-back manner within the combustion chamber, in order to heat the working fluid with the high temperature gas from the burner, and a cylinder head for installing the plurality of heat exchanger pipe along the circumference of a concentric circle, with approximately equal distance apart and a tilt of a predetermined angle, on the first cylinder, in order to equalize the length of the passage of the working fluid between the first cylinder and the regenerator, as well as for give a fixed head clearance for the pipes in the combustion chamber.

These and other objects and advantages of the present invention will be more apparent from the following description of a preferred embodiment, taken in conjunction with the accompanying drawings.

DESCRIPTION OF THE PREFERRED EMBODIMENT

Figure 1:
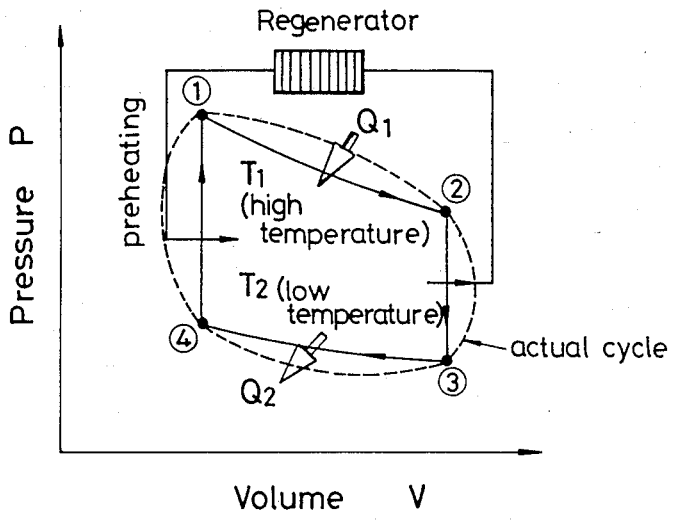
FIG. 1 is the P-V chart for the Stirling cycle.
Figure 2:
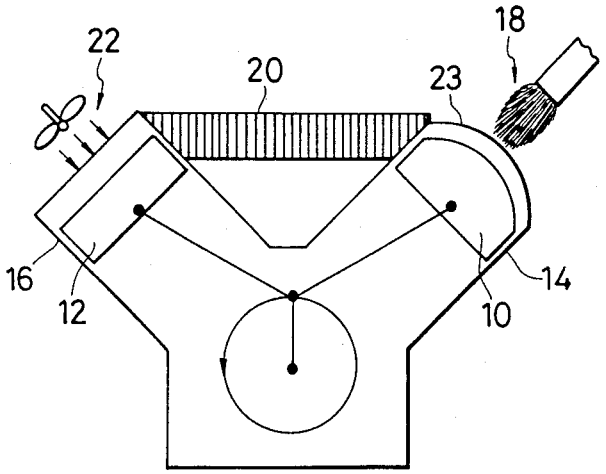
FIG. 2 is a fundamental block diagram for a general Stirling engine of two-piston type.
Figure 3:
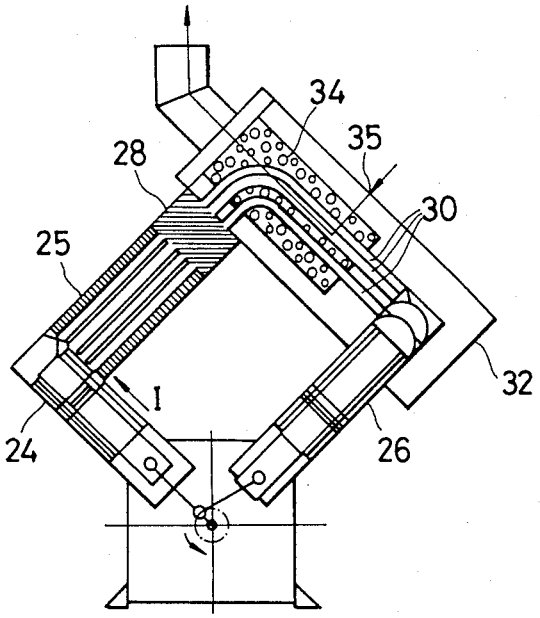
FIG. 3 is a simplified block diagram for a prior art Stirling engine of two-piston type.
Figure 6:
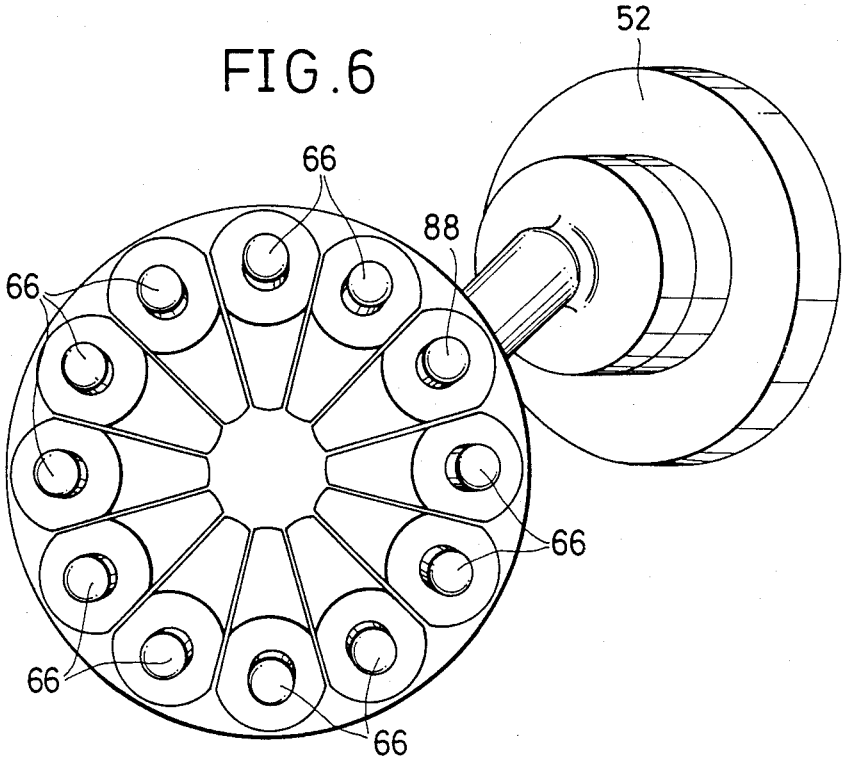
FIG. 6 is a view of the Stirling engine shown in FIG. 4 as seen in the direction of the arrow VI.
Figure 4:
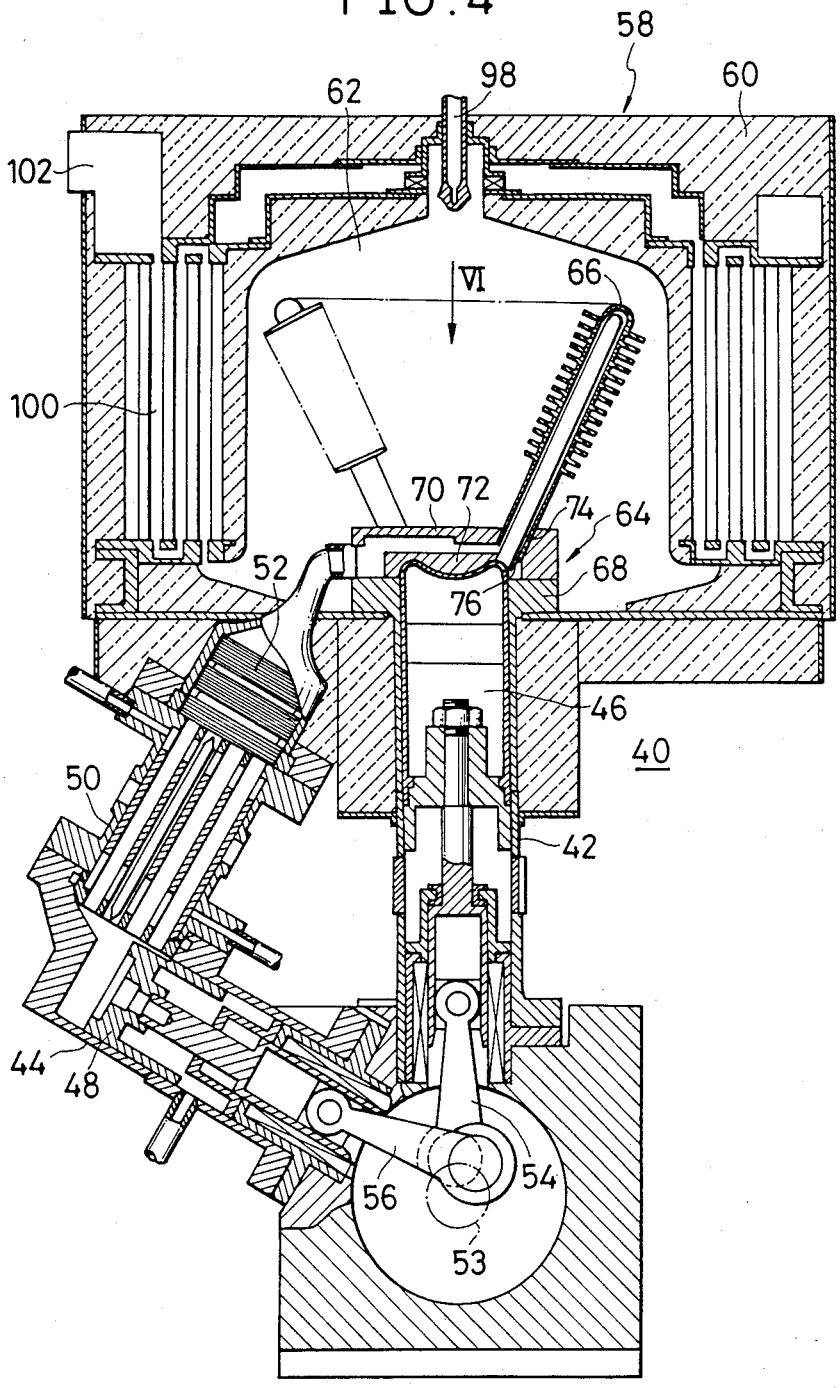
FIG. 4 is an overall crosssection view of a Stirling engine embodying the present invention.

Referring to FIG. 4, a Stirling engine embodying the present invention is shown with reference numeral 40. The Stirling engine 40 includes a first cylinder 42 fixed in the direction of the gravity and a second cylinder 44 which is installed on the first cylinder with a predetermined angle of inclination with respect to the first cylinder, where a first power piston 46 is housed freely movably in the first cylinder 42 and a second power piston 48 is housed freely movably in the second cylinder 44. The angle subtended by the two cylinders is chosen to permit the two pistons to be drivable with a phase difference of 90°. At the top section of the section cylinder 44 there is attached a cooler 50 to which is attached a regenerator 52. The first power piston 46 and the second power piston 48 are joined to a crankshaft 53 through the connecting rods 54 and 56 so as to impart a rotation to the crankshaft 53 by the movement of the first power piston 46 and the second power piston 48.

Figure 5:
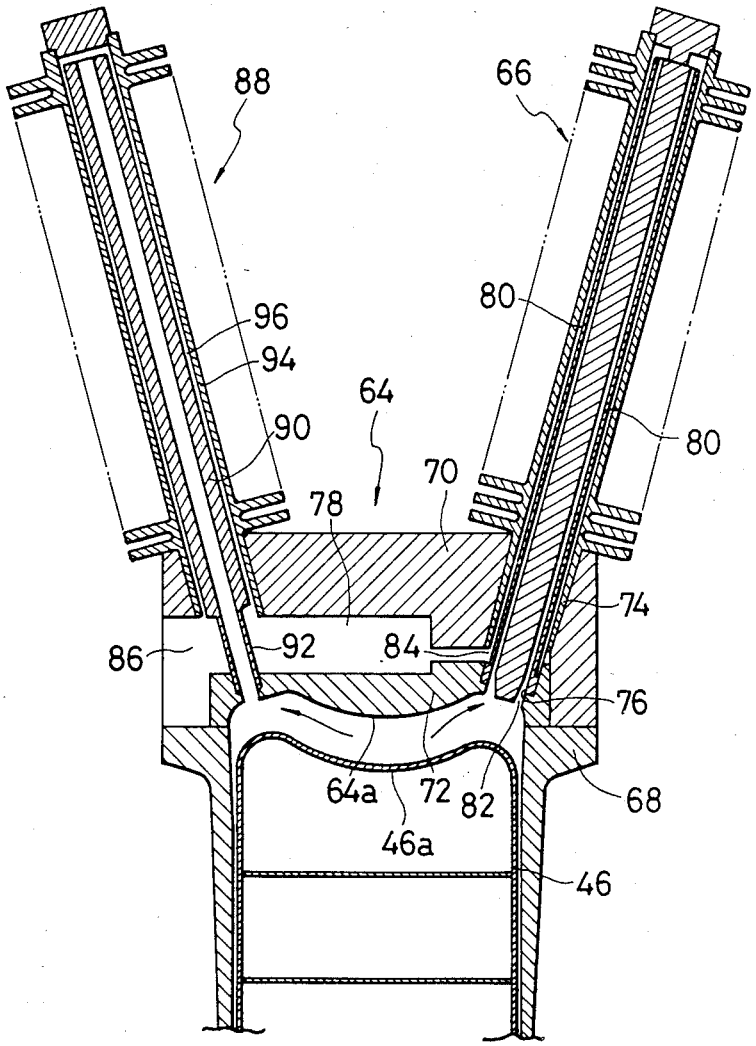
FIG. 5 is an enlarged crosssection view of the heat exchanger pipe section of the Stirling engine shown in FIG. 4.
Figure 7:
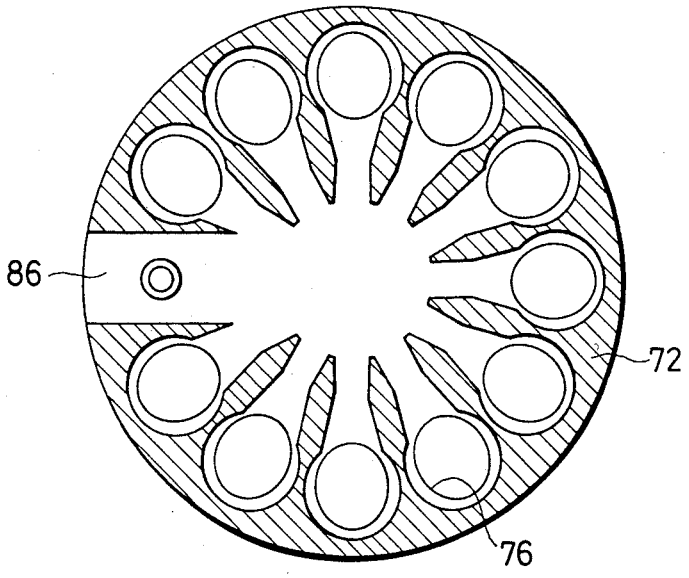
FIG. 7 is a plan view of the manifold part of the heat exchanger pipe section shown in FIG. 5.

At the upper part of the expansion cylinder 42 there is provided a heater 58, and the heater has a combustion chamber 62 at the upper part of the expansion cylinder 42 formed by a heat insulating material 60. At the outer periphery in the top section of the first cylinder head 64 there are installed a plurality of heat exchanger pipes 66 along the circumference of a circle with a tilt which is predetermined. That is, the cylinder head 64 comprises a lower part of the cylinder head 68, an upper part of the cylinder head 70, and a manifold material 72 which is inserted between the lower part of the cylinder head 68 and the upper part of the cylinder head 70, as shown by FIG. 5. In the upper part of the cylinder head 70 and the manifold material 72 there are provided a plurality of holes 74 and 76 for installing the plurality of heat exchanger pipes 66 with a tilt of predetermined angle. The cylinder head 64 is constructed so as to form a manifold section 78 when the heat exchanger pipes 66 are installed, and within each of the heat exchanger pipe 66 there is provided a passage 80 for the gas, formed by doubly turning the pipe back on itself. One end 82 of the gas passage 80 is opened to the upper part of the first cylinder 42, while the other end 84 is opened to the manifold section 78 by turning back on itself. In the manifold section 78 there is provided a passage to the regenerator 86 for introducing the gas to the regenerator 52. At the position corresponding to the passage to the regenerator 86 there is installed a special heat exchanger pipe 88 with a construction which is different from other heat exchanger pipes 66.

In the heat exchanger pipe 88 there is provided an inner heat exchanger pipe 90, as shown by FIG. 5, and within the inner heat exchanger pipe 90 there is provided a small tube 92 which is connected to the first cylinder 42 by penetrating through the passage to the regenerator 86. In addition, on the outside of the inner heat exchanger pipe 90 there is provided an outer tube 94 which is connected to the small tube 92 and also to the manifold 78. Moreover, there is formed a cup-shaped depression at the top center of the first power piston 46, and a semispherical bulge 64*a* is formed on the bottom surface of the first cylinder head 64, that is, the bottom surface of the manifold material 72, corresponding to the shape of the depression 46*a*.

With the construction described as in the above, the working fluid which flows from the first cylinder 42 through one end 82 of the gas passage 80 into the heat exchanger pipe 66, is transported to the side of the regenerator 52 from the other end 84 of the gas passage 80 through the manifold section 78. The working fluid, which flows from the first cylinder 42 through the inside of the small tube 92 into the special heat exchanger pipe 88, is arranged to flow out to the side of the regenerator 52 through the gap between the inner heat exchanger pipe 90 and the outer tube 94 and the manifold section 78. The numerous routes to manifold section 78 configured with the heat exchange rods have the same length, i.e., the flow area of element 66 equals the flow area of element 88. As a consequence, the length of the channel for the working fluid from the first cylinder through the heat exchanger pipes 66 and 88 to the regenerator 52 are uniform and hence, the amount of flow of the working fluid is uniform also. In other words, the flow resistances of the routes are equalized, so that the flowing of the working fluid and heat exchange rates on the rods are uniform. Therefore, the temperature of the heat exchanger pipes 66 and 88, too, becomes uniform, and that it becomes possible to set the heating temperature of the heat exchanger pipes 66 and 88 in the combustion chamber at a high value. This enables one to improve the output performance of the engine by improving heat exchange efficiency. In addition, the heat exchanger pipes 66 and 88 are arranged to have one of their respective ends fixed, although the other ends are free. As a consequence, even when the heat exchanger pipes 66 and 88 are expanded through heating, the elongation in the direction of the axis of the heating pipes can be absorbed, so that the expansion will give no adverse effects to the other parts of device.

Moreover, in the upper part of the combustion chamber 62 there is provided a burner 98 for injecting the high temperature gas, and the exhaust gas that is generated in the combustion chamber 62 is discharged from the exhaust gas pipe 102 through a preheater 100. With the above construction, the high temperature gas generated by the burning at the burner 98 heats up the heat exchanger pipes 66 and 88 as it circulates within the combustion chamber 62, and flows out to the side of the preheater 100 by passing through the space between the heat exchanger pipes 66 and 88. Here, the duct resistances for the spaces between the heat exchanger pipes 66 and 88 are approximately equal because of the nearly equally spaced arrangement of the heat exchanger pipes 66 and 88. Accordingly, the distribution of the amount of flow of the high temperature gas is nearly uniform, heating all of the heat exchanger pipes 66 and 88 in a more uniform fashion. Moreover, the heat of the high temperature gas can be transferred to the heat exchanger pipes 66 in a more efficient manner since the heat exchanger pipes 66 and 88 are installed tilted with a predetermined angle, as was mentioned earlier.

When the working fluid is heated and supplied to the inside of the first cylinder 42 through heating of each of the heat exchanger pipes 66 and 88, the first power piston 46 in FIG. 4 goes downward to turn the crankshaft 53. When the first power piston 46 goes upward, the working fluid is discharged from the first cylinder 42 and flows into the cooler 50 through the regenerator 52. As the working fluid flows out to the cooler 50 it is cooled down by imparting heat to the heat storage material that fills the regenerator 52. In the cooler 50 the working fluid is cooled further and flows into the second cylinder 44. The working fluid that flowed into the side of the second cylinder 44 is compressed during the upward stroke of the second power piston 48, and the compressed working fluid if transported to the side of the regenerator 52. The working fluid flows into the heat exchanger pipes 66 and 88 as its temperature being raised by depriving heat from the heat storage material in the regenerator 52, and there it is heated and expanded again by the high temperature gas. Because the top part of the first power piston 46 is formed concave and the bottom surface of the first cylinder head 64 is formed convex, as was described earlier, during the upward motion of the first power piston 46 the working fluid that is pushed out by the first power piston 46 flows in the directions as indicated by the arrows in FIG. 5. Therefore, compared with the prior art case in which the top part of the piston is formed flat or as a semi-spherical protrusion, the duct resistance in the present case is reduced so that the discharge of the working fluid from the first cylinder 42 can be accomplished more smoothly.

It is to be noted that the present invention is not limited to the embodiment described in the foregoing. Thus, for example, the top part of the compression piston may be formed in concave shape.

In summary, the present invention is accomplished by providing a particular heat exchanger pipe at the position corresponding to the position for the passage to the regenerator that is formed on the expansion cylinder head for a Stirling engine. Therefore, the duct resistances for the spaces in a plurality of heat exchanger pipes that are arranged in a circular form, become nearly equal, which makes it possible to make uniform the distribution of amount of flow of the high temperature gas in the combustion chamber. In addition, the area for heat exchange is increased by providing a particular heat exchanger pipe at the position corresponding to the passage to the regenerator, so that it becomes possible to achieve a further improvement in the heat exchange efficiency. Furthermore, the flow resistance for the working fluid is reduced by forming a depression in the top part of the piston so that it becomes possible to decrease the pressure loss in the working fluid as well as to increase the amount of exchanged heat through an increase in the area of heat exchange.

Various modifications will become possible for those skilled in the art after receiving the teachings of the present disclosure without departing from the scope thereof.

What is claimed is:

1. A Stirling engine comprising (A) a first cylinder and a second cylinder with a first piston and a second piston, respectively, that have a fixed phase difference between them, wherein (i) the first cylinder and the second cylinder are connected through a heater, a regenerator and a cooler, (ii) a fixed amount of working fluid is sealed in the first cylinder and the second cylinder, and (iii) the engine is driven by heating or cooling the working fluid by the heater or the cooler;

(B) a plurality of heat exchange pipes attached to the cylinder head of said first cylinder for communication between a manifold section and said first cylinder;

(C) said manifold section, being formed by said cylinder head of said first cylinder for communicating with the regenerator and comprising a central region, situated on the longitudinal axis of the first cylinder, to which working fluid from said heat exchange pipes converges before flowing into said regenerator; and (D) a burner for heating said heat exchange pipes, wherein at least one heat exchange pipe is configured differently from the other pipes of said plurality but provides a duct resistance that is substantially equal to the duct resistance presented by each of said other pipes.

2. A Stirling engine comprising (A) a first cylinder and a second cylinder with a first piston and a second piston, respectively, that have a fixed phase difference between them, said first cylinder comprising a cylinder head, wherein (i) the first cylinder and the second cylinder are connected through a heater, a regenerator and a cooler, (ii) a fixed amount of working fluid is sealed in the first cylinder and the second cylinder, and (iii) the engine is driven by heating or cooling the working fluid by the heater or the cooler;

(B) a combustion chamber attached to said first cylinder;

(C) a burner for introducing a combustible substance into said combustion chamber;

(D) a manifold provided on said cylinder head;

(E) a plurality of heat exchange members wherein are provided looped passages, each of which projects from said cylinder head and which presents substantially the same duct resistance to the working fluid passing therethrough, wherein each of said passages has an inlet communicating with said first cylinder and an outlet communicating with said manifold;

(F) a plurality of passages connected with adjacent heat exchange members, respectively, which passages open into a central region of said manifold through which said exchange members are interconnected; and (G) a passage through which the working fluid from said central region is introducted into said regenerator, wherein at least one heat exchange member of said plurality (E) is configured differently from the other heat exchange members of said plurality.

3. A stirling engine as claimed in claim 2, wherein said burner faces said cylinder head of said first cylinder.

4. A Stirling engine as claimed in claim 2, wherein said heat exchange members are attached to the cylinder head in a concentric configuration such that each heat exchange member is inclined at a predetermined angle relative to said axis of said first cylinder.

5. A Stirling engine as claimed in claim 4, wherein said cylinder head comprises a cylinder head upper part, a cylinder head lower part, and said manifold section between the cylinder head lower part and the cylinder head upper part, said cylinder head upper part having a plurality of holes for installing said plurality of heat exchanger members in said concentric configuration.

6. A Stirling engine as claimed in claim 5, wherein said plurality of heat exchanger members are arranged such that an approximately equal distance separates each pipe.

7. A Stirling engine as claimed claim 6, in wherein a heat exchanger member installed at the position corresponding to the passage to the regenerator comprises an inner heat exchanger pipe with a small tube connected to said first cylinder by penetrating through the passage to the regenerator, and an outer tube that jackets the inner heat exchanger pipe and connected to the small tube as well as to the manifold section to form a fluid passage by the small tube and the outer tube.

8. A Stirling engine as claimed in claim 5, wherein a depression is formed at the top center of the first power piston, and a protrusion is formed on the bottom surface of the first cylinder heat to correspond to the shape of the depression.

9. A Stirling engine as claimed in claim 2, wherein said cylinder head comprises a cylinder head upper part, a cylinder heat lower part, and said manifold section between the cylinder head lower part and the cylinder head upper part, said cylinder head upper part having a plurality of holes for installing said plurality of heat exchanger pipes in said concentric configuration.

* * * * *